United States Patent [19]

Levigion

[11] Patent Number: 4,994,799

[45] Date of Patent: Feb. 19, 1991

[54] SYSTEM FOR THE ELECTRICAL TRANSMISSION OF AN ANGULAR POSITION

[75] Inventor: Manfred Levigion, Kelkheim, Fed. Rep. of Germany

[73] Assignee: VDO Adolf Schindling AG, Frankfurt am Main, Fed. Rep. of Germany

[21] Appl. No.: 381,138

[22] Filed: Jul. 14, 1989

[30] Foreign Application Priority Data

Sep. 24, 1988 [DE] Fed. Rep. of Germany ..... 3832517

[51] Int. Cl.[5] ..... G08C 19/06; G08C 19/38

[52] U.S. Cl. ..... 340/870.3; 340/870.34

[58] Field of Search ..... 340/870.3, 870.02, 870.34, 340/870.09

[56] References Cited

U.S. PATENT DOCUMENTS

| | | | |
|---|---|---|---|
| 2,724,969 | 11/1955 | Bloser | 340/870.34 |
| 2,901,680 | 8/1959 | Goldman, Jr. | 340/870.34 |
| 3,156,907 | 11/1964 | Lanning et al. | 340/870.34 |
| 3,696,363 | 10/1972 | Ljung | 340/870.34 |
| 3,825,911 | 7/1974 | Burns | 340/870.34 |
| 4,193,059 | 3/1980 | Harris | 340/870.09 |
| 4,268,819 | 5/1981 | Wakayama | 340/870.34 |
| 4,619,230 | 10/1986 | Collonia | 123/325 |

*Primary Examiner*—Donald J. Yusko
*Assistant Examiner*—Yuk H. Lau
*Attorney, Agent, or Firm*—Martin A. Farber

[57] ABSTRACT

In a system for the electrical transmission of an angular position, in particular from a measurement instrument to an indicating instrument, in which a transmitter and a receiver each have a rotor and a stator which has multiple pairs of poles, an alternating voltage is fed to a winding of the rotor of the transmitter, and voltages induced in the windings of the stator of the transmitter are transmitted to the windings of the stator of the receiver. The winding of the rotor of the receiver is connected to a phase-sensitive rectifier to which the alternating voltage which is also transmitted can furthermore be fed. The output of the phase-sensitive rectifier is connected to a controller for a motor which is provided for driving the rotor of the receiver and the indicating instrument.

3 Claims, 3 Drawing Sheets

| INPUT SIGNALS | | | | OUTPUTS TRANS-ISTOR | | DESCRIPTION | EFFECT ON MOTOR |
|---|---|---|---|---|---|---|---|
| SA | SE | R | Z | 60 | 61 | | |
| − | − | N | N | − | − | NORMAL OPERATION | FOLLOWS CONTROLLER |
| + | N | + | N | + | − | RETURN TRAVEL + BOTTOM STOP | STOP |
| + | N | − | N | − | − | UPWARD TRAVEL + BOTTOM STOP | FOLLOWS CONTROLLER |
| N | + | − | N | + | − | UPWARD TRAVEL + UPPER STOP | STOP |
| N | + | + | N | − | − | RETURN TRAVEL + UPPER STOP | FOLLOWS CONTROLLER |
| N | + | − | + | − | + | FORCED RETURN TRAVEL | TRAVELS BACKWARD |

Fig. 3

SYSTEM FOR THE ELECTRICAL TRANSMISSION OF AN ANGULAR POSITION

FIELD AND BACKGROUND OF THE INVENTION

The present invention relates to a system for the electrical transmission of an angular position, in particular from a measurement instrument to an indicating instrument, in which a transmitter and a receiver each have one rotor and one stator with multiple pairs of poles, and wherein alternating voltage is fed to a winding of the rotor of the transmitter, and voltages induced in the windings of the stator of the transmitter are transmitted to the windings of the stator of the receiver.

In particular, for the transmission of the angular position from a measurement instrument to an indicating instrument, systems are known in which the transmitter and the receiver (also called syncros) have the same mechanical construction, each having a rotor with a single pair of poles which is supplied with alternating voltage of, for instance, 400 Hz, and a stator with three pairs of poles. The stator of the transmitter produces by induction three alternating voltages the amplitudes of which change with the angular position of the rotor. The three alternating voltages produce in the similar coils of the receiver a magnetic field which is followed by the receiver rotor.

These known systems have proven themselves in particular due to their robust structure, but no torque is produced in the neutral position of the receiver rotor, so that as a result of friction a hysteresis is produced between the receiver rotor and the transmitter rotor.

SUMMARY OF THE INVENTION

It is an object of the present invention to provide a system for the electrical transmission of an angular position in which, as far as possible, no hysteresis occurs.

According to the system of the present invention, the winding (11) of the rotor (10) of the receiver is connected to a phase-sensitive rectifier (12) to which there is furthermore fed the alternating voltage which is also transmitted, and the output of the phase-sensitive rectifier (12) is connected to a controller (21) for a motor (17) which is provided for driving the rotor (10) of the receiver and of the indicating instrument (14).

The receiver syncro is thus no longer used as an actively setting member but serves as a vector transformer and is adjusted by the controller and the setting motor until the voltage induced in the rotor becomes zero. In this way there is avoided, on the one hand, the hysteresis caused by the system, while, on the other hand, variations in voltage do not affect the precision of the positioning.

By the system in accordance with the invention, a good static and dynamic precision can be obtained, due essentially to the electronic controller.

In accordance with a further development of the invention it is proposed to superimpose an additional alternating voltage on the voltage fed to the motor (17). Any possibly existing residual error can in this way be further reduced, since in this further development the effect of friction is reduced by a slight vibration of the setting motor, the transmission and the indicating instrument.

The system of the present invention is, to be sure, able to cause the receiving rotor and/or the indicating instrument to follow the course of the transmitter rotor in both directions. However, if, as a result of a disturbance, an angular distance of more than 180 should be produced between the receiver and the transmitter, then the receiver rotor will endeavor, after the end of the disturbance, to reach the position of the transmitter rotor in the unintended direction of rotation. In the case of indicating instruments with an angle of less than 360°, the indicator needle would in such case travel against the "wrong" stop.

In order to avoid such consequences of defects, another further development of the invention proposes associating a monitoring circuit (22) with the controller (21), which monitoring circuit can be controlled by limit switches (24, 25) and a timer element (72, 73) in such a manner that, as a function of the position of the limit switches, of the sign of the controller output voltage and of the running down of the timer element, the motor (17) can be fed the normal correcting variable obtained by a desired-value/actual-value comparison, a signal for backward travel, or a signal for stopping the motor.

Further according to the invention, the monitoring circuit includes a logic circuit in accordance with the following function table:

| Input Signals | | | | Output Signals |
|---|---|---|---|---|
| SA | SE | R | Z | cause the following |
| – | – | N | N | Motor follows controller |
| + | N | + | N | Motor stops |
| + | N | – | N | Motor follows controller |
| N | + | – | N | Motor stops |
| N | + | + | N | Motor follows controller |
| N | + | – | + | Motor travels backward |

in which:
SE = Position of switch at end position stop
SA = Position of switch at starting position stop. (+ = stop has been reached)
R = Controller output signal. (– = Upward travel. + = return travel)
Z = timer element (+ = time has run down)
N = not possible or irrelevant.

BRIEF DESCRIPTION OF THE DRAWING

With the above and other objects and advantages in view, the present invention will become more clearly understood in connection with the detailed description of preferred embodiments, when considered with the accompanying drawing, of which:

FIG. 3 is a table explaining a monitoring circuit included in the circuit of FIG. 2.

Identical parts in the figures have been provided with the same reference numbers.

DETAILED DESCRIPTION OF THE PREFERRED EMBODIMENT

Figure 1:
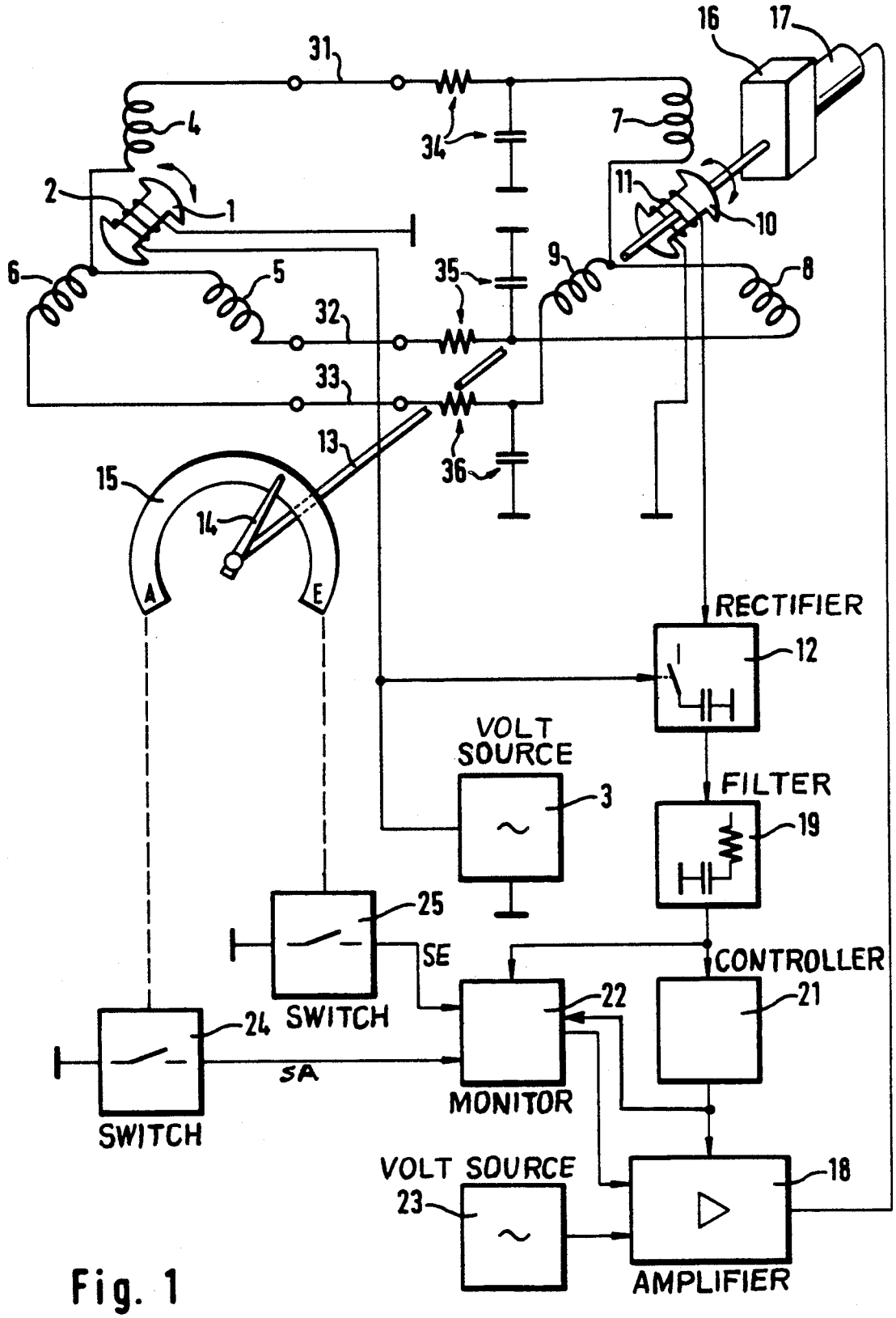
FIG. 1 is a diagrammatic showing of the embodiment.

In the embodiment of FIG. 1, a transmitter is formed by a rotor 1, the winding 2 of which is connected to a source 3 of alternating voltage. The source 3 of alternating voltage can, for instance, be a power supply with a frequency of 400 Hz, frequently used in aeronautical and space technology. The stator is essentially formed of three windings 4, 5, 6, which are connected to the corresponding windings 7, 8, 9 of the receiver stator by lines 31, 32, 33 and low-pass filters 34, 35, 36. The rotor 10 of the receiver has a winding 11 which is connected to inputs of a phase-sensitive rectifier 12. Via a shaft 13, the rotor is furthermore mechanically connected to an indicator needle 14 which, together with a graduated scale 15, constitutes an indicating instrument; A and E indicate a starting end stop and a finishing end stop.

The rotor 10 is driven via the shaft 13, and a transmission 16 is driven by a motor 17 which receives operating voltage from a amplifier 18.

An output of the phase-sensitive rectifier 12 is connected to the input of the amplifier via a low-pass filter 19 and a controller 21. Further inputs of the amplifier are connected from a monitoring circuit 22 and from an additional source 23 of alternating voltage, the latter, as already mentioned, serving to reduce the friction. The monitoring circuit 22 receives the output signal of the low-pass filter 19 and also input signals from two limit switches 24, 25.

The voltage induced in the winding 11 has an amplitude which is dependent on the angular position of the rotor 1 of the transmitter. By means of the phase-sensitive rectifier 12, which is known per se, there is produced an initially still pulsating DC voltage, which is smoothed by means of the low-pass filter 19. The output voltage of the low-pass filter 19 indicates the angular position of the rotor 1 and is fed to a controller 21 as difference between desired value and actual value. In the embodiment shown, the controller 21 is developed as PD-controller but can, depending on the conditions in the individual case, also have a different time behavior. By a corresponding rotation by means of the motor 17, the rotor 10 is brought by the controller system described into that position which the rotor 1 also assumes.

Figure 2:
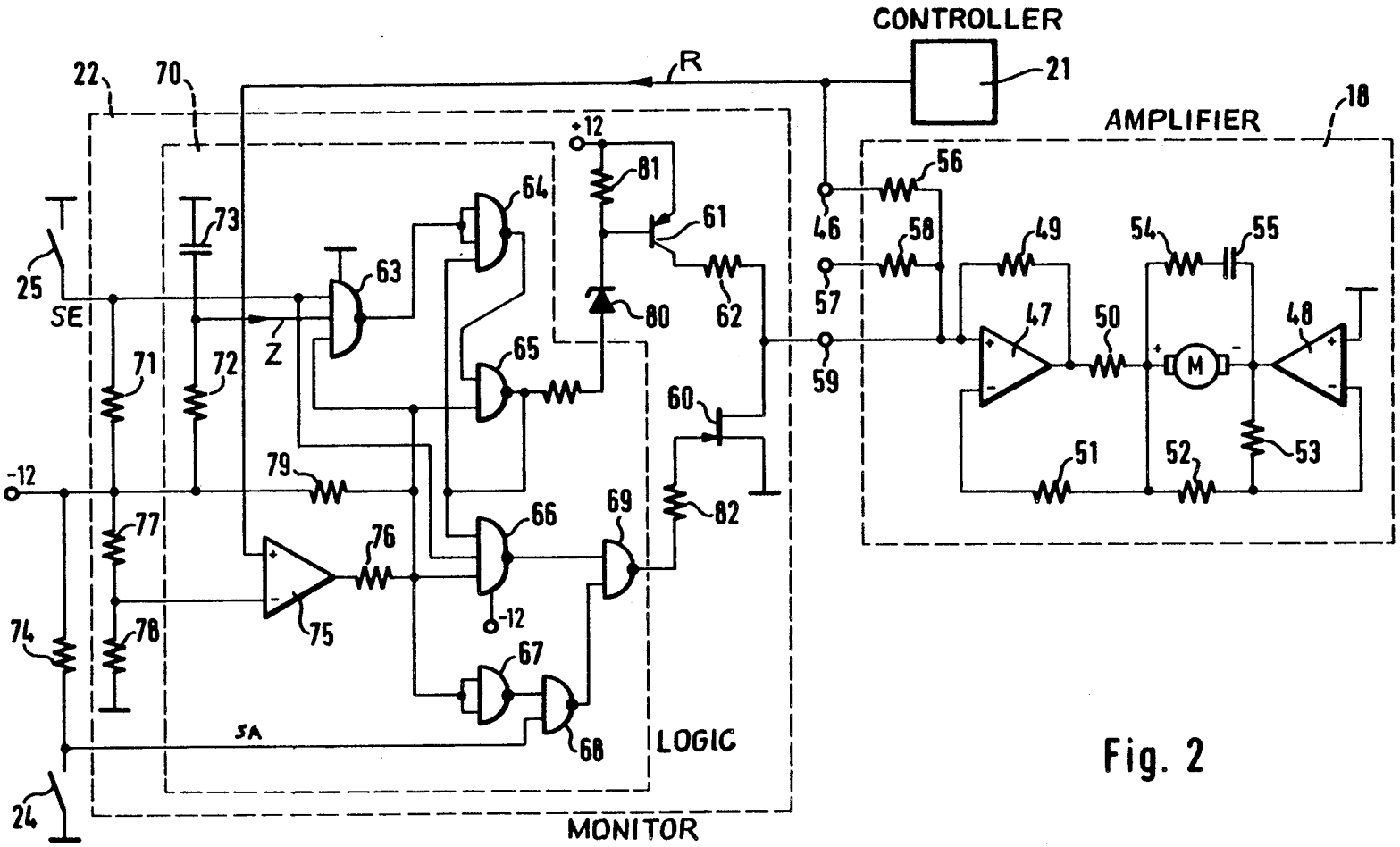
FIG. 2 is a circuit diagram of a part of the embodiment of FIG. 1.

FIG. 2 shows the controller 21, the monitoring circuit 22 and the amplifier 18, in each case as a block diagram. The output voltage of the controller 21 is fed to a first input 46 of the amplifier 18 as correcting variable for the motor 17. The amplifier 18 consists essentially of two differential amplifiers 47, 48 which, together with resistors 50, 53, are so connected that the motor 17 is acted on by voltages of different sign and can thus rotate in both directions. Such amplifier circuits are known per se and need not be further explained in detail.

The first input 46 of the amplifier 18 is connected to the non-inverting input of the differential amplifier 47 by a decoupling resistor 56. The additional alternating voltage for the reduction of the friction is fed from the source 23 of alternating current (FIG. 1) via the second input 57 and an additional decoupling resistor 58.

By means of a field effect transistor arranged in the monitoring circuit 22, a third input 59 of the amplifier 18 can be short-circuited, so that the motor 17 stops regardless of the amount and the sign of the voltages fed to the inputs 46 and 57. The outputs of the difference amplifiers 47, 48 are of correspondingly low resistance, so that the motor quickly comes to a standstill. A positive input voltage can furthermore be fed to the amplifier by the monitoring circuit 22, so that the motor necessarily brings the indicator needle 14 (FIG. 1) to the initial stop A. A transistor 61 is provided for this purpose in the monitoring circuit 22, which transistor, in conductive state, connects the input 59 to positive voltage via a decoupling resistor 62.

The monitoring circuit 22 contains a logic circuit 70 which consists of gates 63 to 69. Signals SA and SE can be fed to the logic circuit as input variables, said signals indicating that the end positions SA and SE have been reached. The signals SA and SE are given off by the limit switches 24, 25, which are connected, on the one hand, to negative operating voltage via resistors 74, 71 and, on the other hand, to ground potential. The limit switches 24, 25 are so arranged that they are actuated shortly before the mechanical limit stop has been reached, thus making it possible to brake the motor 17 in due time. Damage to the transmission and to the indicating instrument is thus prevented.

Another input variable for the logic circuit is the output voltage of a timer member which consists of a resistor 72 and a capacitor 73. The size of the resistor 72 and of the capacitor 73 is selected in such a manner that the corresponding input signal of the gate 63 changes is logic level about two seconds after switching on. A positive return travel can (together with the signal SE) be triggered in this time.

Finally, the sign of the correcting variable and therefore of the output voltage of the controller 21 forms a further input variable for the logic circuit 70. For this purpose the output voltage of the controller 21 is fed to the inverting input of a difference amplifier 75, the output of which is connected to an input of the logic circuit via a decoupling resistor 76. The non-inverting input of the difference amplifier 75 receives approximately ground potential via a voltage divider 77, 78. A further resistor 79 serves an input of the logic circuit 70 as pull-up resistor.

An output of the logic circuit 70 is connected via a resistor 79 and a Zener diode 80 to the base of the transistor 61 and, via a resistor 81, to the positive pole of the source of operating voltage. An output of the gate 69 controls the field effect transistor 60 via a resistor 82.

Reference is had to the table of FIG. 3 for further explanation of the monitoring circuit 22. In it, SA designates the position of the switch A, SE the position of the switch E, R the output signal of the controller and Z the signal given off by the timer member 72, 73. With respect to the switch positions, a plus sign in each case means that the limit stop in question has been reached, while a plus sign for the input variable Z means the running down of the period of time within which possible positive return travel is initiated. As outputs there are indicated in the Table the states of the transistors 60 and 61, in which connection a plus sign means that the transistor in question is conductive while a minus sign indicates a blocked transistor. N means that in the operating state in question the input variable designated N is either impossible or irrelevant.

In normal operation, the limit stops are not reached. Furthermore, the logic circuit 70 does not take into account the value of the input variables R and Z. Both transistors 60 and 61 are non-conductive, so that the motor 17 is controlled by the controller 21 without action by the monitoring circuit 22.

However, if the initial stop A is actuated (SA = +), then the transistor 60 becomes conductive upon positive controller output voltage R which corresponds to a return travel of the indicator needle, so that electrical braking takes place before the needle runs against the mechanical initial stop. However, if with SA = + the output voltage R of the controller is negative, then the two transistors 60 and 61 remain non-conductive, so that the indicator needle can run up from the initial position in accordance with the pre-set value of the controller.

The same applies by analogy for the reaching of the end stop E (SE = +). If the output voltage R of the contoller is in this case negative, then the indicator needle is braked due to the transistor 60 becoming conductive. However, if the output voltage R of the controller is positive in the region of the end stop E, then the two transistors remain non-conductive, so that the indicator needle can be brought back to its desired position by the controller.

The last line of the Table of FIG. 3 indicates an operating condition which is produced if, due to a temporary defect, a difference of more than 180° has occurred between the desired position and the actual position of the rotor 10. If after such a defect the rotor 10 stands, for instance, at 190° while the desired position is zero degrees, then the indicator needle 14 travels against the upper stop since, corresponding to the properties of the control system, the rotor strives to reach the angle of zero degrees by clockwise rotation. This condition is detected by the monitoring circuit 22 if the controller attempts another upward travel (R=negative) within the pre-set time (Z=+), with the end stop actuated (SE=plus). In this case the logic circuit 70 brings the transistor 61 into the conductive state and blocks the transistor 60, which forces return travel. The rotor 10 is thus forced to effect a return travel, against the control by the controller, whereupon normal operation can be resumed.

I claim:

1. A system for the electrical transmission of an angular position, particularly for transmission of angular position from a measurement instrument to an indicating instrument, the system comprising a transmitter and a receiver, said transmitter and said receiver each having one rotor and one stator, each stator having multiple pairs of poles; and wherein alternating voltage is to be fed to a winding of the rotor of the transmitter, and voltages induced in windings of the stator of the transmitter are to be transmitted to windings of the stator of the receiver; the system further comprising a first source and a second source of alternating voltage, an additional voltage outputted by said second source being independent of any voltage in said receiver;

a phase sensitive rectifier, a motor for driving the rotor of the receiver, a controller for the motor, the motor also driving a rotor of an indicating instrument; and wherein the winding of the rotor of the receiver is connected to said phase-sensitive rectifier;

alternating voltage of said first source is transmitted to said rectifier;

an output of the phase-sensitive rectifier is connected to said controller; and said additional alternating voltage of said second source is superimposed on the voltage fed to the motor.

2. A system for the electrical transmission of an angular position, particularly for transmission of angular position from a measurement instrument to an indicating instrument, the system comprising a transmitter and a receiver each of which has one rotor and one stator, each stator having multiple pairs of poles; and wherein alternating voltage is to be fed to a winding of the rotor of the transmitter, and voltages induced in windings of the stator of the transmitter are to be transmitted to windings of the stator of the receiver; the system further comprising a phase sensitive rectifier, a motor for driving the rotor of the receiver, a controller for the motor, the motor also driving a rotor of an indicating instrument; and wherein the winding of the rotor of the receiver is connected to said phase-sensitive rectifier;

alternating voltage is transmitted to said rectifier;

and an output of the phase-sensitive rectifier is connected to said controller;

an additional alternating voltage is superimposed on the voltage fed to the motor; the system further comprising a monitoring circuit operatively coupled to said controller;

limit switches connected to the monitoring circuit for controlling the monitoring circuit;

a timer element included within the monitoring circuit; and wherein the monitoring circuit includes a logic circuit operative as a function of positions of the limit switches, of the sign of an output voltage of the controller, and of a running down of the timer element, to feed said motor a normal correcting variable obtained by a desired-value/actual-value comparison, a signal for backward travel, or a signal for stopping the motor.

3. A system for the electrical transmission of an angular position according to claim 2 wherein there are two of said limit switches having output signals SA and SE, respectively;

the controller outputs a signal R, and the timer element outputs a signal Z; and said logic circuit operates in accordance with the following function table:

| Input Signals | | | | Output signals |
|---|---|---|---|---|
| SA | SE | R | Z | cause the following |
| − | − | N | N | Motor follows controller |
| + | N | + | N | Motor stops |
| + | N | − | N | Motor follows controller |
| N | + | − | N | Motor stops |
| N | + | + | N | Motor follows controller |
| N | + | − | + | Motor travels backward |

in which:
SE = Position of switch at end position stop
SA = Position of switch at starting position stop, (+ = stop has been reached)
R = Controller output signal, (− = Upward travel, + = return travel)
Z = timer element (+ = time has run down)
N = [not possible or irrelevant] nonoccuring event.

* * * * *